US005697673A

United States Patent [19]

Favaretto

[11] Patent Number: 5,697,673

[45] Date of Patent: Dec. 16, 1997

[54] CHAIR WITH A PIVOTING BACKREST

[76] Inventor: Paolo Favaretto, Via Gabriele Falloppio 39, 35121 Padova, Italy

[21] Appl. No.: 531,965

[22] Filed: Sep. 21, 1995

[51] Int. Cl.[6] ..... A47C 3/00

[52] U.S. Cl. ..... 297/301.1; 297/285; 297/452.15

[58] Field of Search ..... 297/291, 294, 297/297, 299, 301.1, 301.5, 354.11, 452.15, 285

[56] References Cited

U.S. PATENT DOCUMENTS

| | | | |
|---|---|---|---|
| 1,986 | 6/1841 | Staples | 297/301.1 |
| 4,316,632 | 2/1982 | Brauning | 297/291 |
| 4,633,546 | 1/1987 | Bergs | 297/285 X |
| 5,112,108 | 5/1992 | Zapf | 297/301.1 X |
| 5,411,316 | 5/1995 | Lovegrove et al. | 297/452.15 |

FOREIGN PATENT DOCUMENTS

| | | | |
|---|---|---|---|
| 0309368 | 3/1989 | European Pat. Off. . | |
| 706142 | 4/1941 | Germany | 297/301.1 |
| 3001627 | 7/1981 | Germany | 297/452.15 |
| WO8704909 | 8/1987 | WIPO . | |

*Primary Examiner*—Laurie K. Cranmer

*Attorney, Agent, or Firm*—Sughrue, Mion, Zinn, Macpeak & Seas, PLLC

[57] ABSTRACT

A chair with a pivoting backrest includes resilient leaves which cooperate with limbs for supporting the backrest to oppose the pivoting of the backrest towards its pivoted-back position.

5 Claims, 2 Drawing Sheets

CHAIR WITH A PIVOTING BACKREST

BACKGROUND OF THE INVENTION

The present invention relates to chairs of the type comprising a basic frame, a seat supported by the basic frame, a backrest, and a frame for supporting the backrest, the support frame being connected to the basic frame and the backrest being articulated thereto about a transverse axis so as to be movable between a substantially erect position and a pivoted-back position, and resilient means being interposed between the backrest and its support frame in order to bias the backrest towards its erect position.

Previously, chairs of various types having the characteristics indicated above have been proposed both for homes and offices, and for public places such as cinemas, theatres, conference rooms and the like.

SUMMARY OF THE INVENTION

The object of the present invention is to provide a chair of this type which, on the one hand, has a frame which is extremely simple and cheap to manufacture and, on the other hand, is particularly functional, comfortable and suitable for production in aesthetically original and pleasing forms.

In order to achieve this object, the subject of the invention is a chair of the type indicated above, characterized in that the frame for supporting the backrest comprises a pair of lateral supporting limbs each of which has one end connected to the basic frame and the opposite end articulated to the backrest about the aforesaid transverse axis in an intermediate region relative to the height of the backrest, the supporting limbs being disposed behind the backrest so that the lower portion of the backrest bears against their front surfaces when the backrest is in the erect position, the resilient means being constituted by at least one resilient leaf constituting a part of the backrest, situated below the transverse axis and bearing on a rear surface of a respective supporting limb so as to oppose the pivoting of the backrest towards its pivoted-back position.

In a preferred embodiment, each resilient leaf forms an integral part of the backrest structure which is constituted by a single body of synthetic material. In this preferred embodiment, two pairs of lateral resilient leaves are formed integrally, spaced apart one above another, on the two sides of the body of synthetic material constituting the backrest and each extends horizontally from a common region close to the center of the backrest towards a respective side of the backrest where a free end of the leaf bears behind the respective supporting limb of the backrest.

By virtue of the characteristics indicated above, the construction of the chair according to the invention is extremely simple and cheap since the resilient means necessary for biasing the backrest towards the erect position are constituted by an integral part of the backrest.

BRIEF DESCRIPTION OF THE DRAWINGS

Further characteristics and advantages of the invention will become clear from the description which follows with reference to the appended drawings, provided purely by way of non-limiting example, in which.

DETAILED DESCRIPTION OF THE INVENTION

Figure 1:
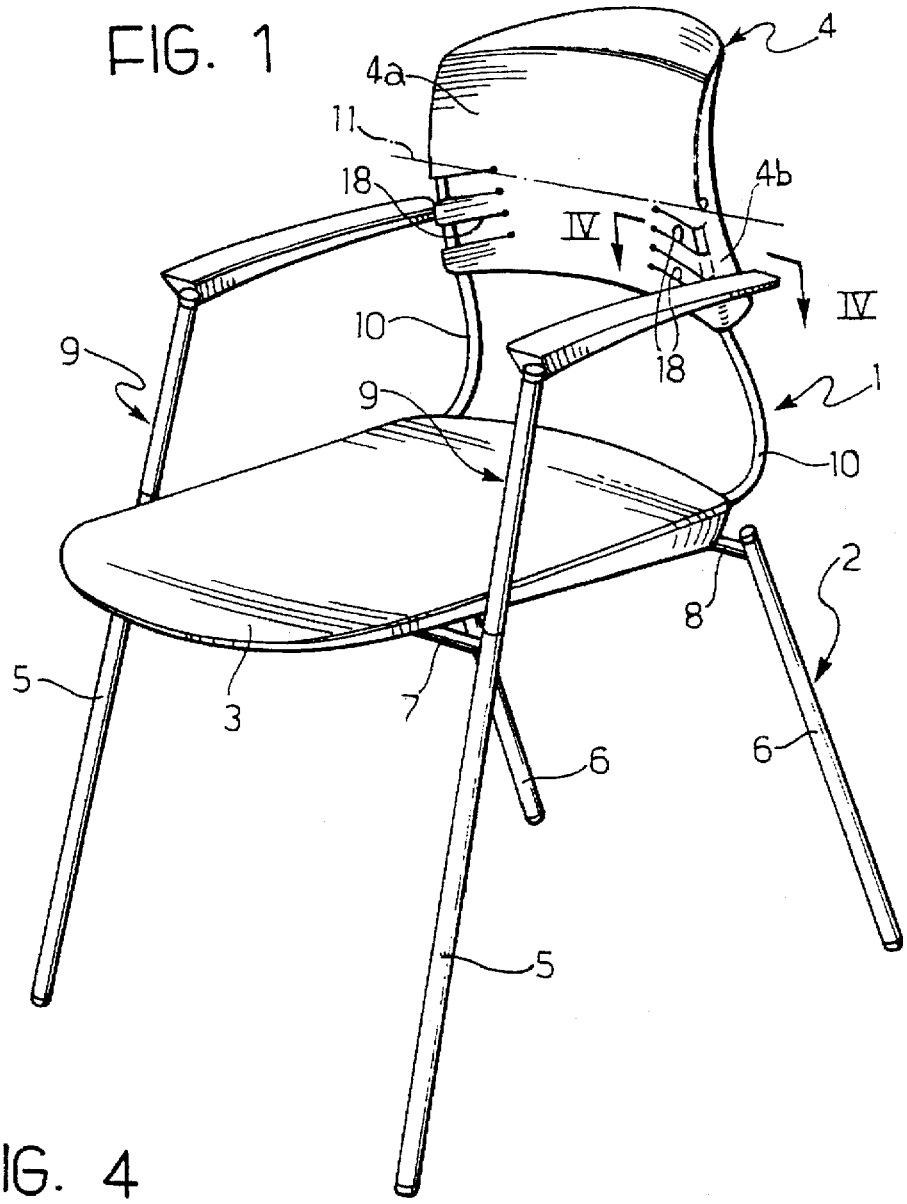
FIG. 1 is a perspective view of a preferred embodiment of the chair according to the invention.

With reference to the drawings, a chair, generally indicated 1, comprises a basic frame 2 bearing a seat 3 and a backrest 4.

In the embodiment shown in the drawings, the basic frame 2 is constituted by a tubular frame including front legs 5 and rear legs 6 joined together at the top by cross-members 7, 8 to which the seat 3 is fixed. Clearly, however, the invention is also applicable to a chair having any other type of basic frame 2. Similarly, although the embodiment shown in the drawings relates to a case in which the seat 3 is connected rigidly to the basic frame, there is nothing to prevent the seat being of the type which pivots relative to its support frame. Finally, the embodiment shown in the drawings provides for a pair of arms 9 carried by two tubular portions fixed to the upper ends of the front legs 5. Clearly, however, the invention is also applicable to chairs without arms or with arms of any other shape.

The backrest 4 is carried by a support frame constituted by a pair of generally L-shaped limbs 10 each of which is connected to the basic frame 2 of the chair at one end and is articulated to the backrest 4 on a common horizontal axis 11 at the opposite end. The two limbs 10 are preferably constituted by the flanges of a single U-shaped element, the central portion of which is connected to the basic frame 2.

In the embodiment shown, the two lateral limbs 10 are connected rigidly to the basic frame 2 of the chair. However, there is nothing to prevent the limbs 10 from being pivotable about the basic frame 2.

Figure 3:
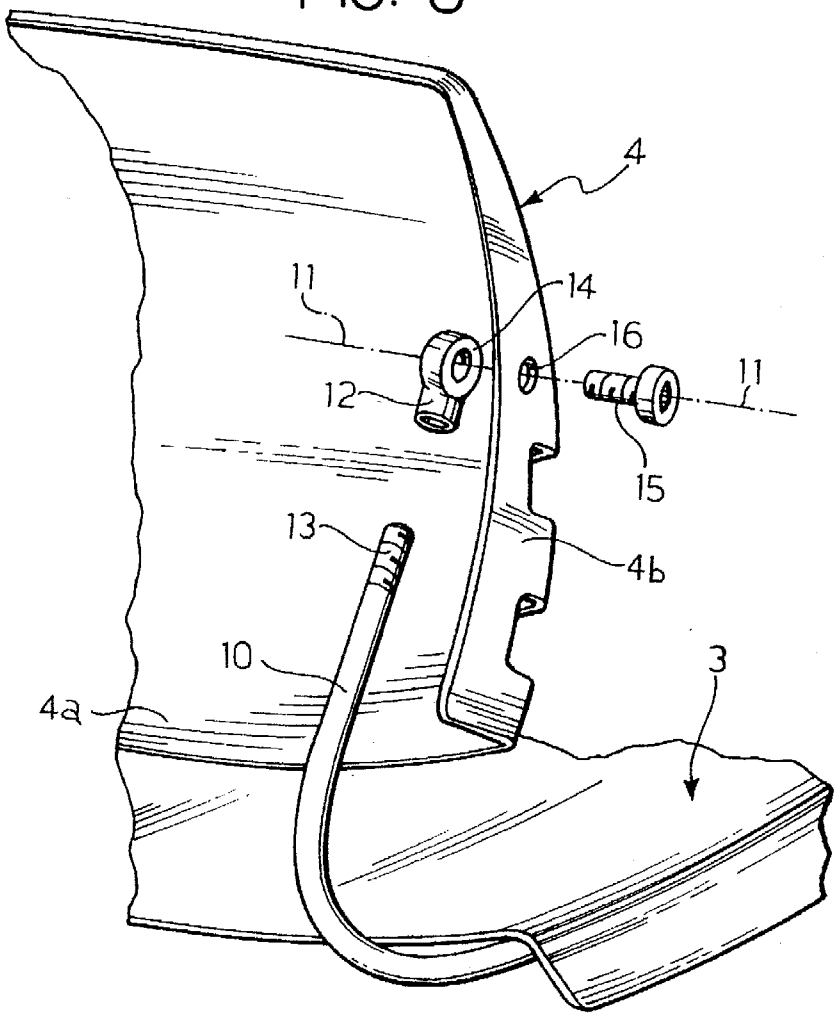
FIG. 3 is an exploded perspective view of a detail of the chair according to the invention.

With reference to FIG. 3, in the embodiment shown, each limb 10 is articulated to the backrest structure 4 by means of a support element 12 which is screwed onto the respective end 13 of the limb 10 and has a threaded hole 14 for the engagement of a screw 15 extending through a hole 16 in the side of the backrest 4 and acting as an articulation pin.

As can be seen in the drawings, the embodiment of the invention shown therein has a backrest 4 constituted by a single body, preferably of synthetic material, having a main wall **4*a* and two sides 4*b***.

Figure 2:
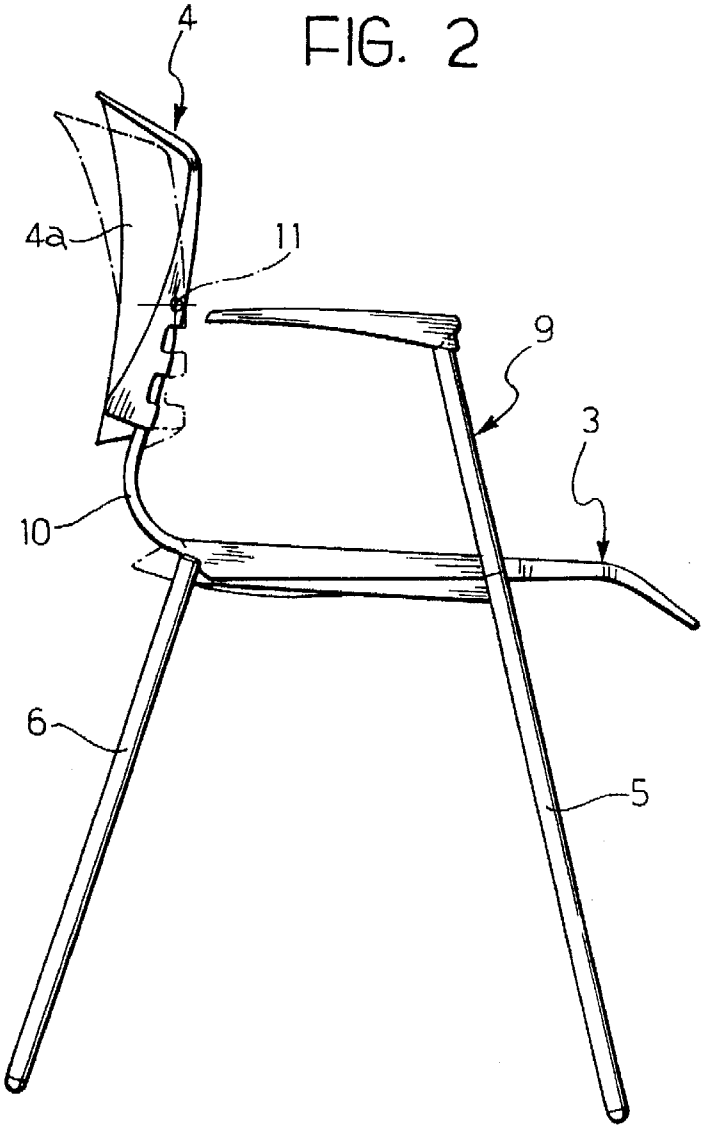
FIG. 2 is a side view of the chair of FIG. 1.

As can be seen in the drawings, the axis 11 of the articulation of the backrest 4 on the two supporting limbs 10 is in an intermediate region relative to the height of the backrest and the two limbs 10 are disposed behind the main wall **4*a* of the backrest. The backrest 4 is therefore movable between a substantially erect position (shown in continuous outline in FIGS. 1 and 2) and a pivoted-back position (shown in broken outline in FIG. 2) corresponding to a relaxation position of the seated person. In the erect position of the backrest 4, its lower portion bears against the front surfaces of the two supporting limbs 10**.

Figure 4:
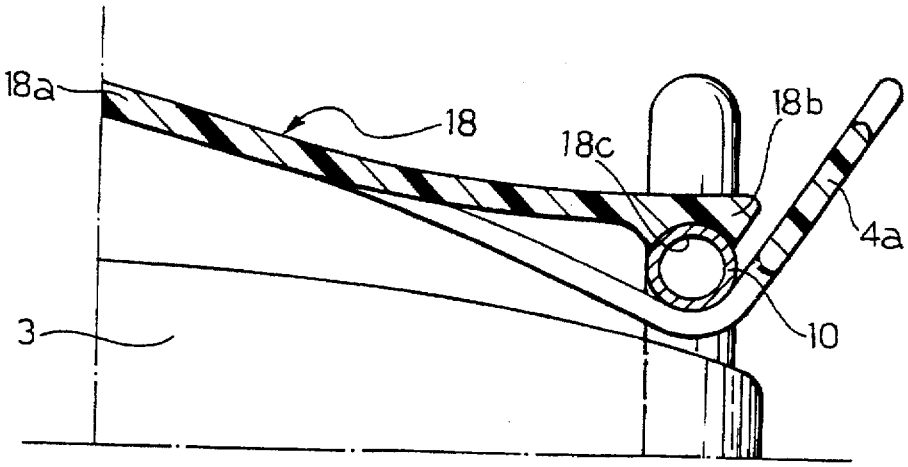
FIG. 4 is a section taken on the line IV—IV of FIG. 1, on an enlarged scale.

Two pairs of resilient leaves 18, spaced apart one above another, are moulded integrally in the main wall **4*a* of synthetic material of the backrest 4. Each leaf 18 extends horizontally from a common region 18*a* (FIG. 4) close to the central portion of the backrest 4 towards a respective side 4*a* of the backrest and its free end 18*b* bears against the rear surface of the respective supporting limb 10. Having regard to the behaviour of the common region 18*a* of each leaf 18, this region may be considered a fixed end of each leaf 18. In the embodiment shown (FIG. 4), the free end of each leaf 18 has a seat 18*c* of a shape corresponding to the rear surface of the supporting limb 10**. In this condition, the resilient leaf 18 is slightly deformed from its normal configuration so that it tends to bias the backrest 4 towards its erect position. Pivoting of the backrest 4 towards its pivoted-back position in fact causes further deformation of each resilient leaf 18. The resilient leaves 18 thus return the backrest towards its erect position when the person occupying the chair ceases to exert a force on the backrest 4 pivoting the backrest backwards with his back.

Naturally, the material constituting the backrest 4 may also be metallic, in which case the backrest will preferably have a covering, or the resilient leaves 18 may be of metal, each having one end incorporated in the synthetic body of the backrest 4. Furthermore, the resilient leaves 18 may be constituted by separate elements mounted on the backrest structure 4 in any known manner. In any case, the use of the resilient leaves 18 means that the backrest structure 4 also performs the function of the resilient means for biasing the backrest towards the erect position.

Naturally, if the seat 3 of the chair is of the pivoting type there is nothing to prevent an arrangement similar to that of the resilient leaves 18 provided on the backrest 4 also being used for the seat.

Finally, the arrangement of the resilient leaves could also be quite different from that shown purely by way of example in the drawings, according to the structure of the backrest 4 and the support frame of the backrest.

Naturally, the principle of the invention remaining the same, the details of construction may also vary with respect to those described and illustrated without thereby departing from the scope of the invention, as defined in the claims.

What is claimed is:

1. A chair comprising a basic frame, a seat supported by the basic frame, a backrest and a support frame for supporting the backrest, the support frame being connected to the basic frame and the backrest being articulated thereto about a transverse axis so as to be movable between a substantially erect position and a pivoted-back position, resilient means being interposed between the backrest and its support frame in order to bias the backrest towards its erect position, wherein the support frame for supporting the backrest comprises a pair of lateral supporting limbs each of which has one end connected to the basic frame and the opposite end articulated to the backrest about the aforesaid transverse axis in an intermediate region relative to the height of the backrest, the supporting limbs being disposed behind the backrest so that the lower portion of the backrest bears against them when the backrest is in the erect position and wherein the backrest is a single body of synthetic material and the resilient means is comprised of at least one horizontally extending resilient leaf having a free end, and constituting an integral part of the backrest situated below the transverse axis and bearing on a rear surface of a respective supporting limb so as to oppose the pivoting of the backrest towards its pivoted-back position.

2. A chair according to claim 1, wherein the backrest has at least two horizontally disposed resilient leaves associated with each supporting limb respectively, and each having one end integral with the backrest, the opposite, free end bearing against the rear surface of the respective supporting limb.

3. A chair according to claim 2, wherein several horizontally disposed resilient leaves are spaced apart one above another and are associated with each supporting limb.

4. A chair according to claim 1, wherein two pairs of horizontally extending resilient leaves are formed integrally on the two sides of the body of synthetic material constituting the backrest and are spaced apart one above another, each pair of leaves extending from a common region close to the center of the backrest towards a respective side of the backrest.

5. A chair according to claim 4, wherein each resilient leaf has a free end with a seat of shape complementary to that of the rear surface of the respective supporting limb with which it cooperates.

* * * * *